US008190074B2

(12) United States Patent
Han

(10) Patent No.: US 8,190,074 B2
(45) Date of Patent: May 29, 2012

(54) FIXING DEVICE AND IMAGE FORMING APPARATUS HAVING THE SAME

(75) Inventor: Ji-min Han, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1112 days.

(21) Appl. No.: 12/047,534

(22) Filed: Mar. 13, 2008

(65) Prior Publication Data

US 2008/0292372 A1 Nov. 27, 2008

(30) Foreign Application Priority Data

May 21, 2007 (KR) ..... 10-2007-0049236

(51) Int. Cl.
*G03G 15/20* (2006.01)

(52) U.S. Cl. ..... 399/328

(58) Field of Classification Search ..... 399/328, 399/329, 330, 335, 336; 219/216
See application file for complete search history.

(56) References Cited

U.S. PATENT DOCUMENTS

| | | | | |
|---|---|---|---|---|
| 4,071,735 | A * | 1/1978 | Moser | 219/216 |
| 4,435,069 | A * | 3/1984 | Sato | 399/336 |
| 5,873,020 | A * | 2/1999 | Matsuura et al. | 399/329 |
| 6,519,439 | B2 * | 2/2003 | Tomita | 399/329 |
| 6,611,670 | B2 * | 8/2003 | Chen et al. | 399/328 |
| 2002/0051659 | A1 * | 5/2002 | Baba et al. | |
| 2003/0053830 | A1 * | 3/2003 | Hachisuka et al. | 399/329 |
| 2003/0206758 | A1 * | 11/2003 | Yasui et al. | 399/329 |
| 2005/0265758 | A1 * | 12/2005 | Haseba et al. | 399/329 |
| 2006/0177251 | A1 * | 8/2006 | Uehara et al. | 399/329 |

FOREIGN PATENT DOCUMENTS

| | | | |
|---|---|---|---|
| JP | 2001324887 | A * | 11/2001 |
| JP | 2006184623 | A * | 7/2006 |
| JP | 2007233236 | A * | 9/2007 |
| KR | 2006-9551 | | 2/2006 |

OTHER PUBLICATIONS

Korean Office Action issued Jun. 17, 2011 in corresponding Korean Patent Application 10-2007-0049236.

* cited by examiner

*Primary Examiner* — Susan Lee
(74) *Attorney, Agent, or Firm* — Staas & Halsey LLP

(57) ABSTRACT

A fixing device to fix an image to a print medium, including: a pressing roller, which is driven to rotate; a heat transferring unit facing the pressing roller, and contacting the pressing roller at a fixing nip position, to heat to a print medium disposed at the fixing nip position; a heating member that presses an portion of the heat transferring unit against the pressing roller at the fixing nip position; and a heat source that heats a preheating position of the heat transferring unit, and heats the heating member.

21 Claims, 5 Drawing Sheets

FIXING DEVICE AND IMAGE FORMING APPARATUS HAVING THE SAME

CROSS-REFERENCE TO RELATED APPLICATIONS

This application claims all benefits accruing under 35 U.S.C. §119 from Korean Patent Application No. 2007-49236, filed on May 21, 2007, in the Korean Intellectual Property Office the disclosure of which is incorporated herein by reference.

BACKGROUND OF THE INVENTION

1. Field of the Invention

Aspects of the present invention relate to a fixing device that fuses an image transferred to a print medium and an image forming apparatus having the same.

2. Description of the Related Art

In general, an electrophotographic image forming apparatus, such as, a laser printer, a photo-copier, a facsimile machine, and a multifunctional produce, prints an image by scanning light onto a photosensitive medium that is charged with a predetermined electric potential, in order to form an electrostatic latent image. The latent image is developed with a predetermined color toner, transferred to the print medium, and then fixed to the print medium. A fixing device is provided along a print path of the image forming apparatus.

Referring to FIG. 1, a conventional fixing device includes a heating roller 3, a heating lamp 1 disposed inside the heating roller 3, a pressing roller 5 facing the heating roller 3, and a temperature sensor 7. The pressing roller 5 is elastically biased toward the heating roller 3 by an elastic member, to form a fixing nip position $N_1$.

The heating roller 3 includes a core pipe 3*a* formed of metal, and an elastic layer 3*b* disposed on the core pipe 3*a*. Radiant energy from the heating lamp 1 is converted into heat by a light-heat converting layer (not shown) disposed on an inner surface of the first core pipe 3*a*, to heat the core pipe 3*a*. Also, the elastic layer 3*b* is heated by thermal conduction to a predetermined fixing temperature.

The temperature sensor 7 can contact, or be adjacent to, the heating roller 3 and measures a surface temperature of the elastic layer 3*a*. Accordingly, power supplied to the heating lamp 1 can be adjusted, based on the surface temperature measured by the temperature sensor 7.

The pressing roller 5 includes a core pipe 5*a* formed of metal, and an elastic layer 5*b* disposed thereon. The elastic layer 5*b* has less elasticity than the elastic layer 3*b*, and the elastic layer 5*b* is distorted when pressed against the pressing roller 5. When a print medium 9 having a toner image 9*a* passes through the fixing nip position $N_1$, the toner image is heated, pressed, and thereby fixed to the print medium 9.

To increase the speed of the image forming apparatus employing the fixing device, the external diameters of the heating roller and the pressing roller can be increased, or the thickness of the elastic layers 3*b* and 5*b* can be increased. Such modifications increase a fixing time of the print medium in the fixing nip position $N_1$, by enlarging the width of the fixing nip position $N_1$, in order to compensate for an increased speed of the image forming apparatus. Such modifications prevent a fixing quality deterioration caused by a decrease of the fixing time of the print medium.

However, there is a practical limit to the enlargement of the external diameters of the heating roller and the pressing roller, because such enlargements increase the total size of the image forming apparatus. Such enlargements also increase a warm-up period of the rollers and increase manufacturing costs.

To solve the warm-up delay, a conventional fixing device employing a local heating method has been disclosed. This fixing device reduces a warm-up time, by disposing the heat source to concentrate heat on the fixing nip position. However, if the print medium is not transported, a pressing member contacting the fixing nip position is damaged, due to overheating of the fixing nip position.

SUMMARY OF THE INVENTION

Aspects of the present invention provide a fixing device to concentrate heat on a fixing nip position in a preheating operation. The fixing device prevents a pressing member from being damaged, by a rapidly cooling the pressing member if a print medium is not transported. Aspects of the present invention relate to an image forming apparatus including the fixing device.

Additional aspects and/or advantages of the invention will be set forth in part in the description which follows and, in part, will be obvious from the description, or may be learned by practice of the invention.

In accordance with an exemplary embodiment of the present invention a fixing device is disposed on a print passage of an image forming apparatus, to fix a toner image onto a print medium. The fixing device includes: a pressing roller, which is driven to rotate; a heat transferring unit rotatably supported to face the pressing roller, to transfer heat to the print medium; a heating member that presses the heat transferring unit against the pressing roller, to form a fixing nip position; and a heat source that heats a preheating position of the heat transferring unit, which is positioned adjacent to an upper path of the fixing device, and supplies heat to the heating member.

According to an aspect of the invention, the heat source heats the preheating position of the heat transmitting unit by radiation. According to aspects of the invention, the heating member includes: a heat conducting part that faces the heat transferring unit, with the heat source interposed therebetween, and receives heat by conduction from the heat source; and a pressing part that extends from the heat conducting part, receives heat conducted from the heat conducting part, heats the fixing nip position, and presses the print medium at the fixing nip position.

According to aspects of the invention, the heat conducting part further includes a reflecting face, which reflects some of a heat radiated from the heat source toward the heat transferring unit. According to an aspect of the invention, the pressing part has a thickness that decreases from the heat conducting part to the fixing nip position.

According to aspects of the invention, the heat source includes a heating lamp, which is disposed between the heat conducting part and the heat transferring unit. According to aspects of the invention, the heat source includes a ceramic heater that is provided on a surface of the heat conducting part, which faces the heat transferring unit.

According to aspects of the invention, the heat transferring unit includes a flexible material. According to aspects of the invention, the heat transferring unit is rotated according to a rotation of the pressing roller.

In accordance with another exemplary embodiment of the present invention, an image forming apparatus is provided with: a photosensitive medium; a light scanning unit, which scans a beam to the photosensitive medium, to form an electrostatic latent image on the photosensitive medium; a developing unit, which develops a toner image with respect to the electrostatic latent image; a transferring unit, which transfers the toner image to a print medium; and a fixing device, which fixes the transferred toner image.

According to aspects of the invention, the heat source heats a preheating position of the heat transmitting unit by radiation. According to an aspect of the invention, the heating member includes: a heat conducting part, which faces the heat transferring unit with the heat source interposed therebetween, and receives heat from the heat source by conduction; and a pressing part, which extends from the heat conducting unit, receives heat, which is absorbed in the heat conducting part by conduction, to heat a the fixing nip position, and presses the print medium in the fixing nip position.

According to aspects of the invention, the heat conducting unit further includes a reflecting face which reflects some of the heat that is radiated from the heat source toward the heat transferring unit. According to aspects of the invention, a thickness of the pressing part decreases from the heat conducting part to the fixing nip position.

According to aspects of the invention, the heat source includes a heating lamp, which is disposed between the heat conducting part and the heat transferring unit. According to aspects of the invention, the heat source includes a ceramic heater, which is provided on a surface of the heat conducting part, which faces the heat transferring unit.

According to aspects of the invention, the heat transferring unit includes a flexible material. According to aspects of the invention, the heat transferring unit is rotated by the pressing roller.

In addition to the example embodiments and aspects as described above, further aspects and embodiments will be apparent by reference to the drawings and by study of the following descriptions.

BRIEF DESCRIPTION OF THE DRAWINGS

A better understanding of the present invention will become apparent from the following detailed description of example embodiments and the claims when read in connection with the accompanying drawings, all forming a part of the disclosure of this invention. While the following written and illustrated disclosure focuses on disclosing example embodiments of the invention, it should be clearly understood that the same is by way of illustration and example only and that the invention is not limited thereto. The spirit and scope of the present invention are limited only by the terms of the appended claims. The following represents brief descriptions of the drawings, wherein:

DETAILED DESCRIPTION OF THE EMBODIMENTS

Figure 1:
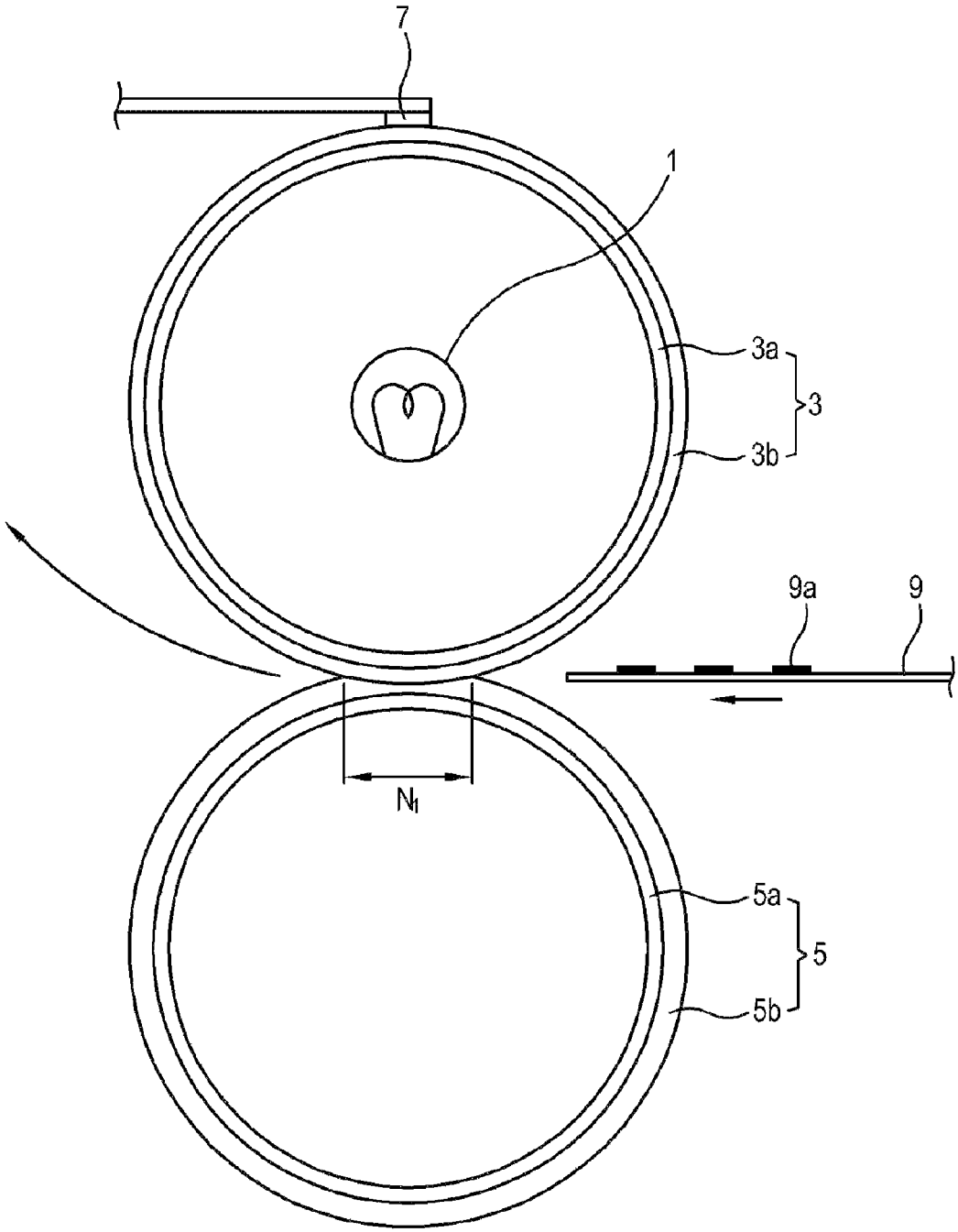
FIG. 1 (RELATED ART)
FIG. 1 is a schematic sectional view illustrating a conventional fixing device.

Reference will now be made in detail to the exemplary embodiments of the present invention, examples of which are illustrated in the accompanying drawings, wherein like reference numerals refer to like elements throughout. The exemplary embodiments are described below in order to explain the present invention by referring to the figures.

Figure 2:
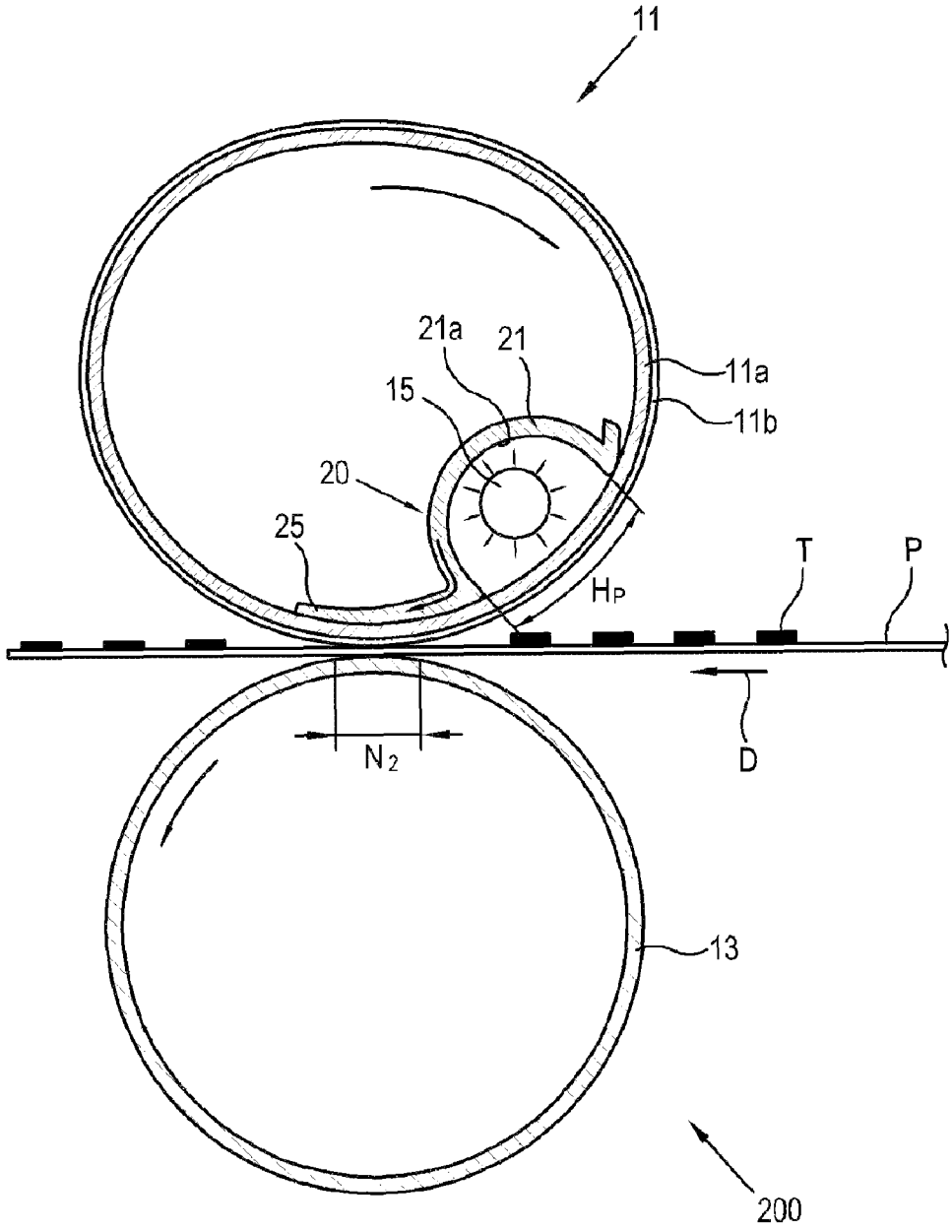
FIG. 2 is a schematic sectional view illustrating a fixing device, according to an exemplary embodiment of the present invention.
Figure 3:
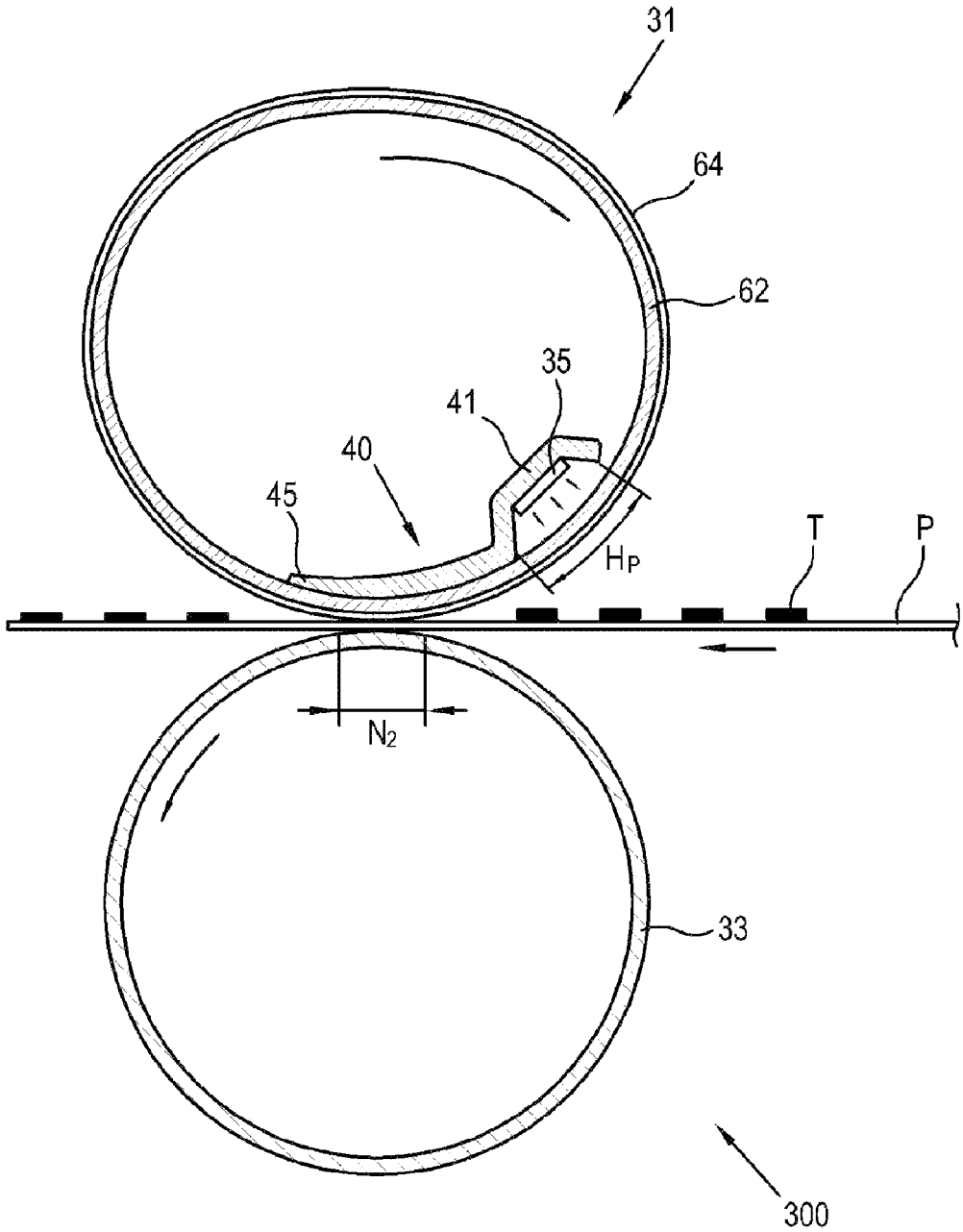
FIG. 3 is a schematic sectional view illustrating a fixing device, according to an exemplary embodiment of the present invention.

FIGS. 2 and 3 are schematic sectional views respectively illustrating fixing devices 200 and 300, according to exemplary embodiments of the present invention. Referring to FIGS. 2 and 3, the fixing devices 200 and 300 are provided on a print path of an image forming apparatus, to fix a toner image T to a print medium P. Referring to FIG. 2, the fixing device 200 includes a heat transferring unit 11, a pressing roller 13 facing the heat transferring unit 11, a heat source 15 disposed in the heat transferring unit 11, and a heating member 20 disposed in the heat transferring unit 11.

The heat transferring unit 11 is rotatably supported and faces the pressing roller 13, such that a print medium P can be disposed therebetween. The heat transferring unit 11 guides a feeding of the print medium P. The heat transferring unit 11 transfers heat supplied from the heat source 15, via the heating member 20, to the print medium P. The heat transferring unit 11 includes a heat transferring layer 11*a*, and a release layer 11*b* formed on the heat transferring layer 11*a*. The release layer 11*b* can prevent the print medium P from sticking thereto during and/or after fixing.

The heat transferring unit 11 may include a flexible material capable of being deformed. A pressing force between the heating member 20 and the pressing roller 13 deforms a portion of the heat transferring unit 11 at a fixing nip position $N_2$. Alternatively, the heat transferring unit 11 may be formed of other materials instead of the flexible material, and may be provided as a roller.

The heat source 15 is disposed in the heat transferring unit 11, heats a preheating position $H_P$ of the heat transferring unit 11, and heats the heating member 20. The preheating position $H_P$ is located adjacent to the fixing nip position $N_2$, and can be rotationally upstream from the fixing nip position $N_2$. The heat transferring unit 11 rotates such that a portion thereof moves from the preheating position $H_P$ to the fixing nip position $N_2$. The preheating position $H_P$ of the heat transferring unit 11 is heated by radiation from the heat source 15.

As shown in FIG. 2, the heat transferring unit 11 rotates in a clockwise direction, and the preheating position $H_P$ is disposed on the right side to the fixing nip position $N_2$. A portion of the heat transferring unit 11 is preheated at preheating position $H_P$ for predetermined time, and then the portion is moved to the fixing nip position $N_2$. The heat source 15 may include a heating lamp disposed between the heating member 20 and the heat transferring unit 11.

The heating member 20 does not move with the heat transferring unit 11. The heating member 20 presses and guides a portion of the heat transferring unit 11 against the print medium P, so that the heat supplied from the heat source 15 can heat portions of the heat transferring unit 11 disposed at the preheating position $H_P$, and the fixing nip position $N_2$.

The heating member 20 includes a heat conducting part 21 and a pressing part 25. The heating member 20 is formed of material having a high thermal conductivity and a mechanical strength sufficient to support the heat transferring unit 11. For example, the heating member 20 may be formed of a metal, such as, a high-strength aluminum alloy, and the like, or a plastic having a high thermal conductivity. The heat conducting part 21 faces the heat transferring unit 11, with the heat source 15 interposed therebetween, and receives heat radiated from the heat source 15.

The heat conducting part 21 may further include a reflecting face 21*a*, to reflect part of the heat radiated from the heat source 15, toward the heat transmitting unit 11. The reflecting face 21*a* may have a concave shape, so that the heat radiated from the heat source 15 can be concentrated on the preheating position $H_P$.

The pressing part 25 is integrally formed with the heat conducting part 21, and extends from one end of the heat conducting part 21. The pressing part 25 receives heat absorbed by the heat conducting part 21 by conduction, to heat the fixing nip $N_2$ position of. The pressing part 25 presses a portion of the heat transferring unit 11 against the print medium P at the fixing nip $N_2$ position.

The pressing part 25 may be thicker where it is attached to the heat conducting part 21 and thinner at an end adjacent to the fixing nip position $N_2$. The variation in the thickness of the pressing part 25 improves fixing in a lower course of the fixing nip $N_2$ position.

The pressing roller 13 faces the heat transferring unit 11, and presses the print medium P against the heating member 20, at the fixing nip position $N_2$. The pressing roller 13 rotates in a counterclockwise direction, if the print medium P proceeds in a direction D, as shown in FIG. 2.

The heat transferring unit 11 is rotated by the rotation of the pressing roller 13. Accordingly, a slip phenomenon at the fixing nip position $N_2$, caused by independently driving the heat transferring unit 11 and the pressing roller 13, can be prevented, thereby preventing the toner image T from being distorted. The pressing roller 13 may be driven by any known driving method.

In the fixing device 200, the heat source 15 is positioned to preheat the preheating position $H_P$, so that a surface temperature of the of the portion of the heat transferring unit 11 at the preheating position $H_P$ can be increased by the preheating, before the print medium P enters the fixing nip position $N_2$. The print medium P can be heated at the fixing nip position $N_2$, by the heat supplied from the heat source 15 and conducted to the fixing nip position $N_2$, through the heating member 20, thereby improving a fixing efficiency.

Referring to FIG. 3, the fixing device 300, includes a heat transferring unit 31, a pressing roller 33 facing the heat transferring unit 31, a heating member 40 disposed in the heat transferring unit 31, and a heat source 35 disposed between the heating member 40 and the heat transferring unit 31. The heat transferring unit 31 includes a heat transferring layer 62 and a release layer 64 disposed upon the heat transferring layer 63.

The heating member 40 is securely disposed in the heat transferring unit 31 and does not rotate with the heat transferring unit 31. The heating member 40 supports the heat transferring unit at the fixing nip position $N_2$. The heat source 35 radiates heat to a preheating position $H_P$ of the heat transferring unit 31, and indirectly heats the fixing nip position $N_2$, via the heating member 40. The heating member 40 includes a heat conducting part 41 and a pressing part 45. The heat source 35 heats the heat conducting part 41, and the heat is then conducted to the pressing part 45. The heating member guides the rotation of the heat transferring unit 31 from the preheating position $H_P$ to the fixing nip position $N_2$.

The heat source 35 may include a ceramic heater disposed on a surface of the heat conducting part 41, facing the heat transferring unit 31. Heat from the heat source 35 is directly transferred to the heat conducting part 41, thereby rapidly heating the fixing nip position N2. The pressing part 45 may get relatively thinner from the heat conducting part 41 to the fixing nip position N2. Accordingly, the total area of the fixing nip position N2 can maintain a uniform temperature.

The fixing device 300 may have substantially the same configuration as the fixing device 200, except for the configuration of the heat source 35 and the heating member. For example, the heat conducting part 41 is depicted as having a flat portion to accommodate the heat source 35. The heat conducting part 41 can be any shape suitable to direct heat from the heat source toward the preheating position $H_P$.

Figure 4:
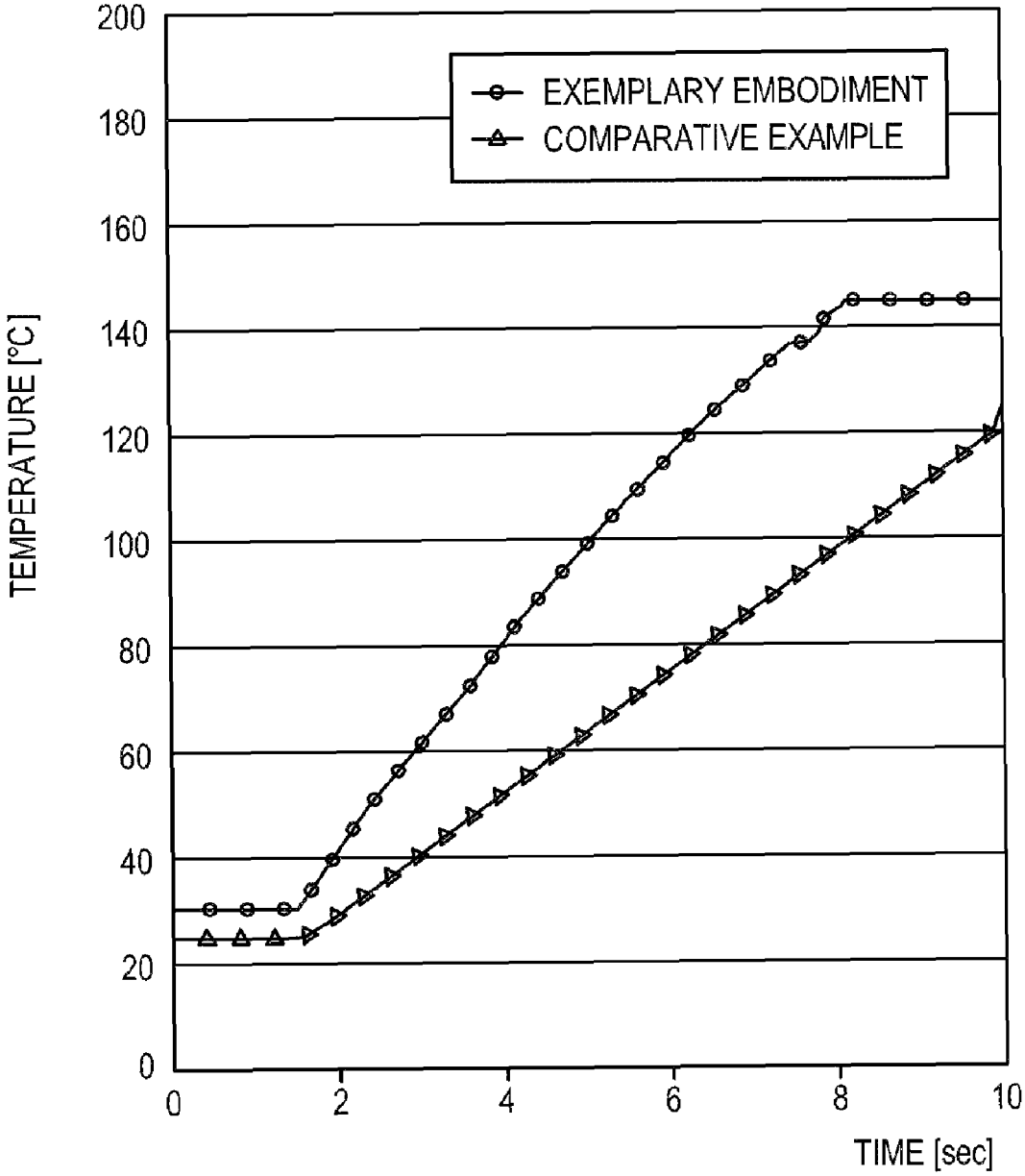
FIG. 4 is a graph comparing temperature distribution variations, over time, of the fixing device, according to an exemplary embodiment of the present invention, with a fixing device of a conventional example.

FIG. 4 is a graph comparing temperature distribution variations over time, of the fixing device 200 to a conventional fixing device. Referring to FIG. 4, it takes approximately 10 seconds to increase the temperature of the conventional fixing device to approximately 120° C. On the other hand, it takes approximately 6 second to increase the temperature of the fixing device 200 to approximately 120° C.

The fixing device 200 demonstrates a more rapid temperature increase as compared with the conventional fixing device. Also, the fixing device 200 can maintain a temperature of approximately 140° C. after approximately 8 seconds of heating. Accordingly, if a width of the fixing nip position $N_2$ is small, or a fixing time is shortened due to increase of a feeding speed of the print medium, the fixing device 200 can increase a heat flux, thereby maintaining suitable fixing characteristics.

The fixing device 200 heats the fixing nip position $N_2$ with heat conducted from the heat source provided at the upper portion of the fixing nip $N_2$ position, and an area the heat can radiate from is large, so that a more rapid cooling can be realized, as compared with the conventional fixing device, when the print medium is not being fed. Accordingly, damage to the heating member 40 can be prevented.

Figure 5:
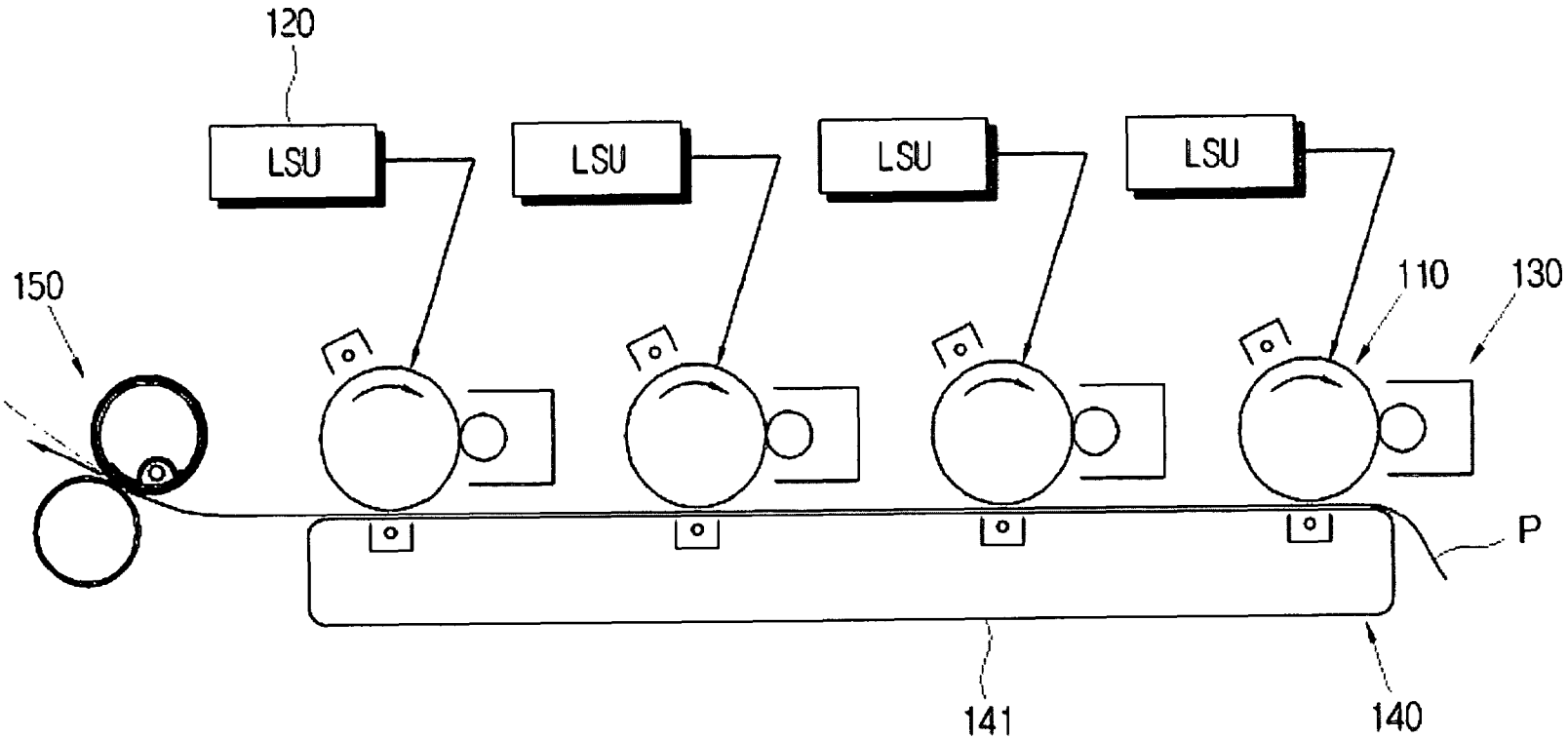
FIG. 5 schematically illustrates an image forming apparatus, according to an exemplary embodiment of the present invention.

FIG. 5 schematically illustrates an image forming apparatus 500, according to an exemplary embodiment of the present invention. Referring to FIG. 5, the image forming apparatus 500 includes: photosensitive media 110; light scanning units (LSUs) 120 to scan a beam to the photosensitive media 110 and to form electrostatic latent images; developing units 130 to develop toner images from the electrostatic latent images; a transferring unit 140 to transfer the toner images to a print medium P, thereby forming an print image; and a fixing device 150 to fix the print image to the print medium P.

The image forming apparatus 500 is a tandem-type, color image forming apparatus. The photosensitive medium 110, the LSUs 120, and the developing units 130 are provided along a feed path of the print medium P according to color.

The transferring unit 140 faces the photosensitive media 110 and the print medium P is fed therebetween, along the feed path. The photosensitive media 110 transfer the toner images to the fed print medium P. The transferring unit 140 includes a transferring belt 141 facing the plurality of photosensitive media 110.

The fixing device 150 is provided adjacent to a feed path of the image forming apparatus 500, to fix the toner images transferred to the print medium P. The fixing device 150 may have substantially the same configuration and operation as the fixing devices 200 and 300.

As described above, a fixing device and an image forming apparatus having the same, according to aspects of the present invention, disposes a heat source adjacent to a heat transferring member, to heat a preheating position of a heat transferring unit. The heat transferring unit increases a surface temperature of a print medium. The preheating position is heated before the print medium enters a fixing nip position, thereby reducing a temperature increase time, maintaining a high fixing temperature, and improving a fixing efficiency.

Also, the fixing device, according to the exemplary embodiments of the present invention, heats the fixing nip position by conduction. Accordingly, an area of heat radiation is large, and allows for an increased cooling speed, as compared with the conventional fixing device, when the print medium is not being fed, thereby preventing a pressing roller from being damaged.

As referred to herein, a print medium can be any medium that can be printed upon. For example, a print medium can be any type of printable paper, a transparency, and the like.

While there have been illustrated and described what are considered to be exemplary embodiments of the present invention, it will be understood by those skilled in the art and as technology develops that various changes and modifications, may be made, and equivalents may be substituted for elements thereof without departing from the true scope of the present invention. Many modifications, permutations, additions and sub-combinations may be made to adapt the teachings of the present invention to a particular situation without departing from the scope thereof. For example, the heat conducting part can have a variety of shapes to accommodate various types of heat sources, and/or to reflect a portion of radiated heat from various types of heat sources. Accordingly, it is intended, therefore, that the present invention not be limited to the various exemplary embodiments disclosed, but that the present invention includes all embodiments falling within the scope of the appended claims.

What is claimed is:

1. A fixing device to fix an image to a print medium, comprising:

a pressing roller;

a heat transferring unit that is rotatably supported to face the pressing roller at a fixing nip position, to transfer heat to a print medium disposed at the fixing nip position to fix an image thereto;

a heating member disposed inside the heat transferring unit, comprising:

a heat conducting part having a surface that faces a preheating position and a heat source; and a pressing part connected to the heat conducting part, to support the heat transferring unit at the fixing nip position, and to conduct heat from heat conducting part to the heat transferring unit at fixing nip position, wherein the heat source is disposed between the heat transferring unit and the heating member, to heat the preheating position of the heat transferring unit, which is adjacent to the fixing nip position, and to heat the heating member, and wherein the heat conducting part is disposed between the heat source and the pressing part.

2. The fixing device as claimed in claim 1, wherein the heat source radiates heat to the preheating position.

3. The fixing device as claimed in claim 1, wherein the surface of the heat conducting part reflects a portion of the heat from the heat source toward the heat transferring unit at the preheating position.

4. The fixing device as claimed in claim 1, wherein the pressing part has a thickness that decreases from the heat conducting part to the fixing nip position.

5. The fixing device as claimed in claim 1, wherein the heat source comprises a heating lamp which is disposed between and spaced apart from the heat conducting part and the heat transferring unit.

6. The fixing device as claimed in claim 1, wherein the heat source comprises a ceramic heater disposed directly upon the surface of the heat conducting part.

7. The fixing device as claimed in claim 1, wherein the heat transferring unit comprises a flexible material.

8. The fixing device as claimed in claim 7, wherein the heat transferring unit is rotated by a rotation of the pressing roller.

9. The fixing device as claimed in claim 1, wherein the pressing part has a curvature that corresponds to a curvature of the heat transferring unit.

10. The fixing device as claimed in claim 1, wherein the surface has a concave shape to reflect a portion of the heat from the heat source toward the preheating position.

11. An image forming apparatus, comprising:

a photosensitive medium;

a light scanning unit to scan a beam on the photosensitive medium, to form an electrostatic latent image on the photosensitive medium;

a developing unit to develop a toner image on the electrostatic latent image;

a transferring unit to transfer the toner image to a print medium to form a print image; and a fixing device to fix the print image to the print medium, wherein the fixing device comprises, a pressing roller;

a heat transferring unit that is rotatably supported to face the pressing roller at a fixing nip position, and to heat a print medium disposed at the fixing nip position to fix an image thereto; and a heating member disposed inside the heat transferring unit, comprising:

a heat conducting part having a surface that faces a preheating position and a heat source; and a pressing part connected to the heat conducting part, to support the heat transferring unit at the fixing nip position, and to conduct heat from heat conducting part to the heat transferring unit at fixing nip position, wherein the heat source is disposed between the heat transferring unit and the heating member, to heat the preheating position of the heat transferring unit, which is adjacent to the fixing nip position, and to heat the heating member, and wherein the heat conducting part is disposed between the heat source and the pressing part.

12. The image forming apparatus according to claim 11, wherein the heat source radiates heat to the preheating position of the heat transferring unit.

13. The image forming apparatus as claimed in claim 12, wherein the pressing part has a thickness that decreases from the heat conducting part to the fixing nip position.

14. The image forming apparatus as claimed in claim 12, wherein the heat source comprises a heating lamp which is disposed between and spaced apart from the heat conducting part and the heat transferring unit.

15. The image forming apparatus as claimed in claim 11, wherein the first surface is to reflect a portion of the heat from the heat source toward the preheating position.

16. The image forming apparatus as claimed in claim 11, wherein the heat source comprises a ceramic heater disposed directly upon the first surface of the heat conducting part.

17. The image forming apparatus as claimed in claim 11, wherein the heat transferring unit comprises a flexible material.

18. The image forming apparatus as claimed in claim 17, wherein the heat transferring unit is rotated by a rotation of the pressing roller.

19. The image forming apparatus as claimed in claim 11, wherein the surface at least partially defines the preheating position.

20. The image forming apparatus as claimed in claim 11, wherein the pressing part has a curvature that corresponds to a curvature of the heat transferring unit.

21. The image forming apparatus as claimed in claim 11, wherein the surface has a concave shape to reflect a portion of the heat from the heat source toward the preheating position.

* * * * *